US005557704A

United States Patent [19]

Dennis et al.

[11] Patent Number: 5,557,704

[45] Date of Patent: Sep. 17, 1996

[54] HEATING VESSEL WITH CHROMIUM-ENRICHED STAINLESS STEEL SUBSTRATE PROMOTING ADHERENCE OF THIN FILM HEATER THEREON

[75] Inventors: Michael E. Dennis, Wiltshire; David Huddart, Avon, both of United Kingdom

[73] Assignee: Pifco Limited, Manchester, United Kingdom

[21] Appl. No.: 352,851

[22] Filed: Dec. 2, 1994

Related U.S. Application Data

[63] Continuation of Ser. No. 62,159, May 17, 1993, abandoned, which is a continuation of Ser. No. 789,330, Nov. 8, 1991, abandoned.

[30] Foreign Application Priority Data

Nov. 9, 1990 [GB] United Kingdom ..... 9024419

[51] Int. Cl.[6] ..... H05B 3/00; F24H 1/00

[52] U.S. Cl. ..... 392/480; 392/458; 219/543; 338/307; 148/606

[58] Field of Search ..... 219/543; 392/480, 392/495, 465, 438, 439, 458, 459, 467, 441; 29/611, 620; 99/279; 338/307–309; 428/666; 148/605, 606

[56] References Cited

U.S. PATENT DOCUMENTS

| | | | |
|---|---|---|---|
| 1,233,796 | 7/1917 | Lyche | 392/441 X |
| 1,365,499 | 1/1921 | Kelley | 338/308 |
| 1,870,619 | 8/1932 | Flanzer | 219/543 X |
| 2,257,668 | 9/1941 | Becker et al. | 148/240 |
| 3,108,170 | 10/1963 | Murphy | 392/459 |
| 3,178,913 | 4/1965 | Olson | 219/543 |
| 3,197,335 | 7/1965 | Leszynski | 338/307 |
| 3,349,722 | 10/1967 | Davis | 219/543 |
| 3,505,498 | 4/1970 | Shevlin | 219/543 |
| 3,784,788 | 1/1974 | Fourny | 392/447 X |
| 4,038,519 | 7/1977 | Foucras | 392/495 X |
| 4,244,755 | 1/1981 | Brockway et al. | 148/606 |
| 4,266,987 | 5/1981 | Wang | 427/444 |
| 4,326,552 | 4/1982 | Bleckmann | 392/495 X |
| 4,358,666 | 11/1982 | Taylor | 219/437 X |
| 4,645,910 | 2/1987 | Chhatwal | 219/437 |
| 4,859,835 | 8/1989 | Balderson | 219/543 |
| 4,888,465 | 12/1989 | Hoffmann | 392/467 |
| 4,888,467 | 12/1989 | Hoffmann | 219/543 X |
| 4,920,868 | 5/1990 | Gehrmann | 99/279 |
| 5,027,425 | 6/1991 | Slomka | 392/480 |
| 5,188,714 | 2/1993 | Davidson et al. | 148/280 |
| 5,270,520 | 12/1993 | Barzilai et al. . | |
| 5,349,747 | 9/1994 | Dennis . | |
| 5,354,967 | 10/1994 | Barzilai et al. . | |

FOREIGN PATENT DOCUMENTS

| | | | |
|---|---|---|---|
| 205619 | 10/1959 | Austria | 392/480 |
| 344289 | 7/1978 | Austria . | |
| 0201967 | 11/1986 | European Pat. Off. . | |
| 285128 | 10/1988 | European Pat. Off. | 148/606 |
| 847074 | 10/1939 | France | 392/480 |
| 208028 | 3/1984 | German Dem. Rep. . | |
| 3201641 | 7/1983 | Germany . | |
| 8300308 | 9/1984 | Netherlands . | |
| 7215829 | 9/1975 | Switzerland . | |
| 270301 | 7/1928 | United Kingdom | 219/543 |
| 513564 | 12/1937 | United Kingdom | 148/60 |
| 2153190 | 8/1985 | United Kingdom | 219/437 |
| WO83/00915 | 3/1983 | WIPO | 392/490 |

*Primary Examiner*—John A. Jeffery
*Attorney, Agent, or Firm*—Watson Cole Stevens Davis, P.L.L.C.

[57] ABSTRACT

A kettle which includes a vessel that provides a chamber for holding water, a pouring spout for dispensing water from the chamber, and a handle for lifting and tilting the vessel during pouring, also includes an electric heating element in the form of a conductive track of a thick film printed circuit on a metal substrate that forms a heated portion of the vessel, the electric heating element being located externally of the chamber.

18 Claims, 8 Drawing Sheets

34
38
30
36
33
40
(THERMAL CUTOUT)
43
31
6
35
33
1
2
41
5
37
39

(TEMPERATURE SENSOR)
(ELECTRIC HEATING ELEMENT)
(ELECTRIC HEATING ELEMENT)
80
81
82
83
84
85
86
87
88
89
90
91
92
93
94

FIG. 7.
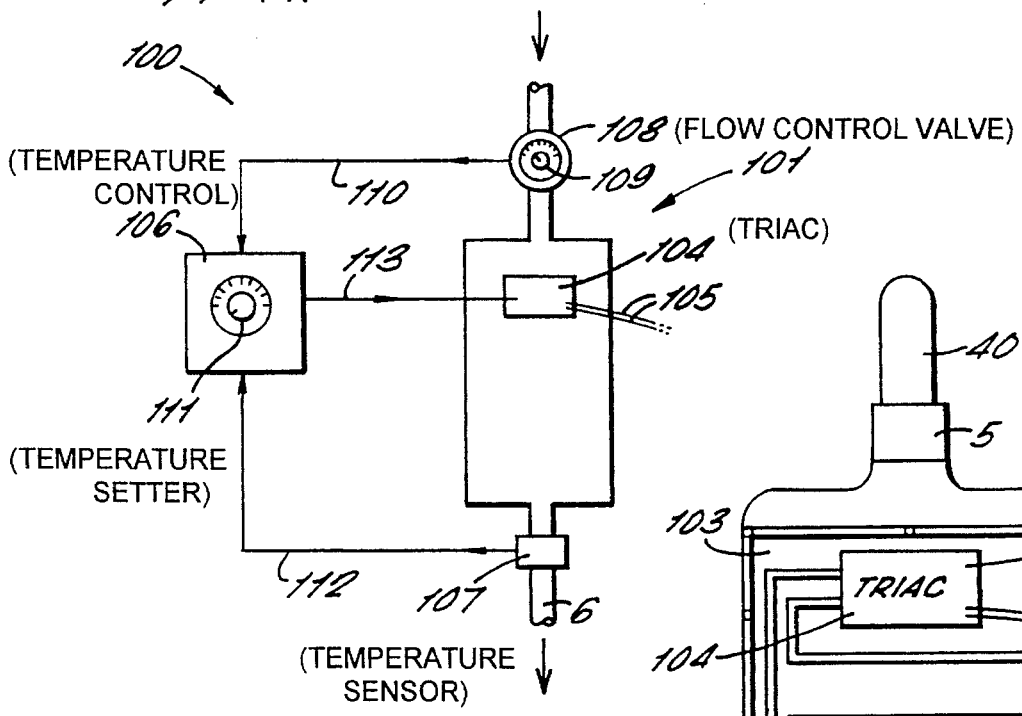
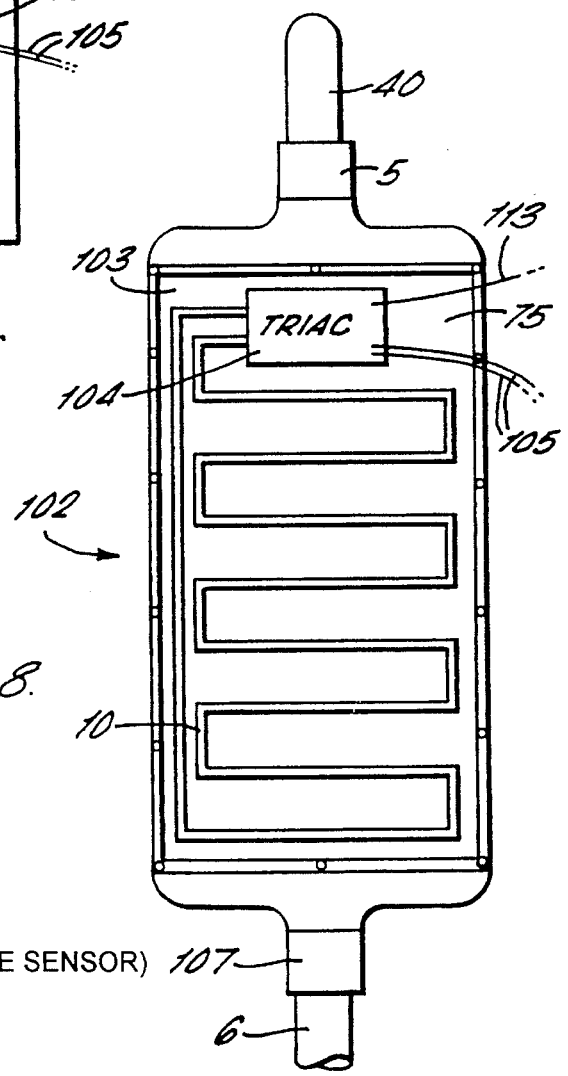
FIG. 8.

HEATING VESSEL WITH CHROMIUM-ENRICHED STAINLESS STEEL SUBSTRATE PROMOTING ADHERENCE OF THIN FILM HEATER THEREON

This is a continuation of application Ser. No. 08/062,159 filed May 17, 1993, now abandoned, which in turn is a continuation of application Ser. No. 07/789,330, filed Nov. 8, 1991, now abandoned.

BACKGROUND OF THE INVENTION

This invention relates to heating apparatus and in particular, but not exclusively, to heating apparatus comprising an electric heating element for a washing machine, tumble dryer, dishwasher, water heater, kettle, shower or hot air blower.

It is known to provide electric heating elements comprising a conductive coil of wire or strip of metal through which electric current is passed to heat the element.

Where it is required to provide electrical heating for fluids such as water contained in a chamber defined by a vessel, an electrical heating element generally needs to be supported within the chamber or is located externally of the chamber at a location where heat is conducted or radiated to the vessel.

SUMMARY OF THE INVENTION

According to the present invention there is disclosed heating apparatus comprising a vessel defining a chamber for holding or conducting fluid to be heated and at least one electric heating element arranged to heat a respective heated portion of the vessel wherein the heating element comprises a conductive track of a thick film printed circuit formed on a dielectric layer adhered to a chromium oxide surface layer of a heat treated stainless steel substrate and wherein the metal substrate constitutes the heated portion of the vessel.

An advantage of this arrangement is that the heating element is formed integrally with the vessel and it is therefore not necessary to provide a separate structure for supporting the heating element.

Preferably the apparatus comprises temperature sensing means comprising a thermistor formed as a conductive track of measurable resistance on the thick film circuit.

Preferably the apparatus includes a thermal cut-out connected to the temperature sensing means and arranged to cut off the flow of electric current through the heating element when the temperature sensed by the temperature sensing means exceeds a limiting value.

The vessel may further comprise an air duct and blower means operable to provide a flow of air through the duct and wherein at least the heated portion of the vessel is located within the duct whereby the apparatus is operable to supply heated liquid and/or heated air.

Such an arrangement is particularly useful in domestic water heaters for showers and the like where the apparatus may also be used to supply hot air to assist drying. It is therefore no longer necessary to provide a separate structure to support a hot air heating element.

Preferably the vessel includes an inlet connectable in use to a source of liquid and an outlet for the delivery of heated liquid from the chamber, temperature sensing means operable to sense the temperature of liquid flowing from the outlet, and control means operable to regulate the heating current flowing through the heating element in response to the sensed temperature so as to maintain the temperature at a required value.

Since a heating element in accordance with the present invention has an inherently low thermal capacity, it makes it suitable for use in a heating apparatus where temperature of the heated liquid is controlled in a closed feedback loop arrangement.

Preferably a current regulating circuit operable to regulate current flowing through the heating element is formed as a thick film circuit on the metal substrate of the heating element.

It is therefore not necessary to provide the current regulating circuit with a separate heat sink since the metal substrate serves as an integrally formed heat sink.

Advantageously the heating apparatus further comprises a valve connected in series with the inlet and operable to continuously vary the flow of liquid through the chamber, the valve being provided with a valve sensor operable to provide a disabling signal to the control means representative of the valve being set to provide a flow rate of liquid below a threshold level, wherein the control means is operable to turn off the current to the heating element in response to the disabling signal.

The disabling signal thereby serves as a safety cut-out to prevent overheating of the heating element when the flow of liquid through the chamber is reduced to a very low level. Where the current regulating circuit is formed on the substrate of the heating element it is also desirable to operate the circuit only when there is a significant flow of liquid through the chamber to ensure that the circuit does not overheat. The circuit will typically be located upstream of the heating element with respect to the flow of liquid so that it is cooled by incoming liquid to the chamber.

Conveniently in one embodiment of the invention the heated portion of the vessel comprises a tubular member defining a fluid passageway and having an external surface upon which the thick film circuit is formed. The element may comprise one or more conductive tracks extending helically along the external surface and the connecting means may comprise at least one collar having terminal means cooperating with the conductive track or tracks.

Such an arrangement is particularly useful as a water heater where the tubular member may be connected in series with a water supply pipe to produce hot water.

The vessel may alternatively constitute a drum for a washing machine, clothes dryer, dishwasher or the like, the heated portion comprising a panel removably connected to the drum such that a face of the panel forms part of the internal surface of the drum and further comprising seal means operable to peripherally seal the panel to the drum.

Such an arrangement is preferable to existing drums which include a well within which a conventional heating element is mounted so as to project into the well. When used to heat water as in the case of a washing machine, such wells remain filled with water thereby increasing the total mass of water to be heated during each washing cycle. The contents of the well are also leaked when it is necessary to service the apparatus by removing the heating element. The apparatus of the present invention however avoids the need for a well so that the apparatus is more efficient by virtue of having a lower mass of water to be heated at each cycle.

The heating apparatus may alternatively comprise a kettle having a steam sensor connected to a current regulating circuit formed as a thick film circuit on the metal substrate of the heating element, the circuit being operable in a water boiling mode to deliver a maximum level of current to the heating element until boiling point is sensed by the steam sensor and thereafter to operate in a water simmering mode in which a reduced level of current is delivered to the heating apparatus.

Such an arrangement has the advantage of avoiding excessive cooling of the water after boiling point is reached and ensures that an unattended kettle of water can be rapidly returned to boiling point when use is required.

Preferably the circuit is connected to temperature sensing means formed on the thick film circuit and is operable in the water simmering mode to regulate the current so as to maintain a required temperature.

Conveniently the kettle includes switch means operable to manually select water boiling mode or water simmering mode.

Preferably the substrate is stainless steel.

BRIEF DESCRIPTION OF THE DRAWINGS

Particular embodiments of the present invention will now be described by way of example only and with reference to the accompanying drawings of which:

FIG. 7 is a schematic diagram of a further alternative apparatus comprising a water heater for a shower;

FIG. 8 is a front elevation of a heater assembly of the heating apparatus of FIG. 7;

DETAILED DESCRIPTION OF THE PREFERRED EMBODIMENT

Figure 1:
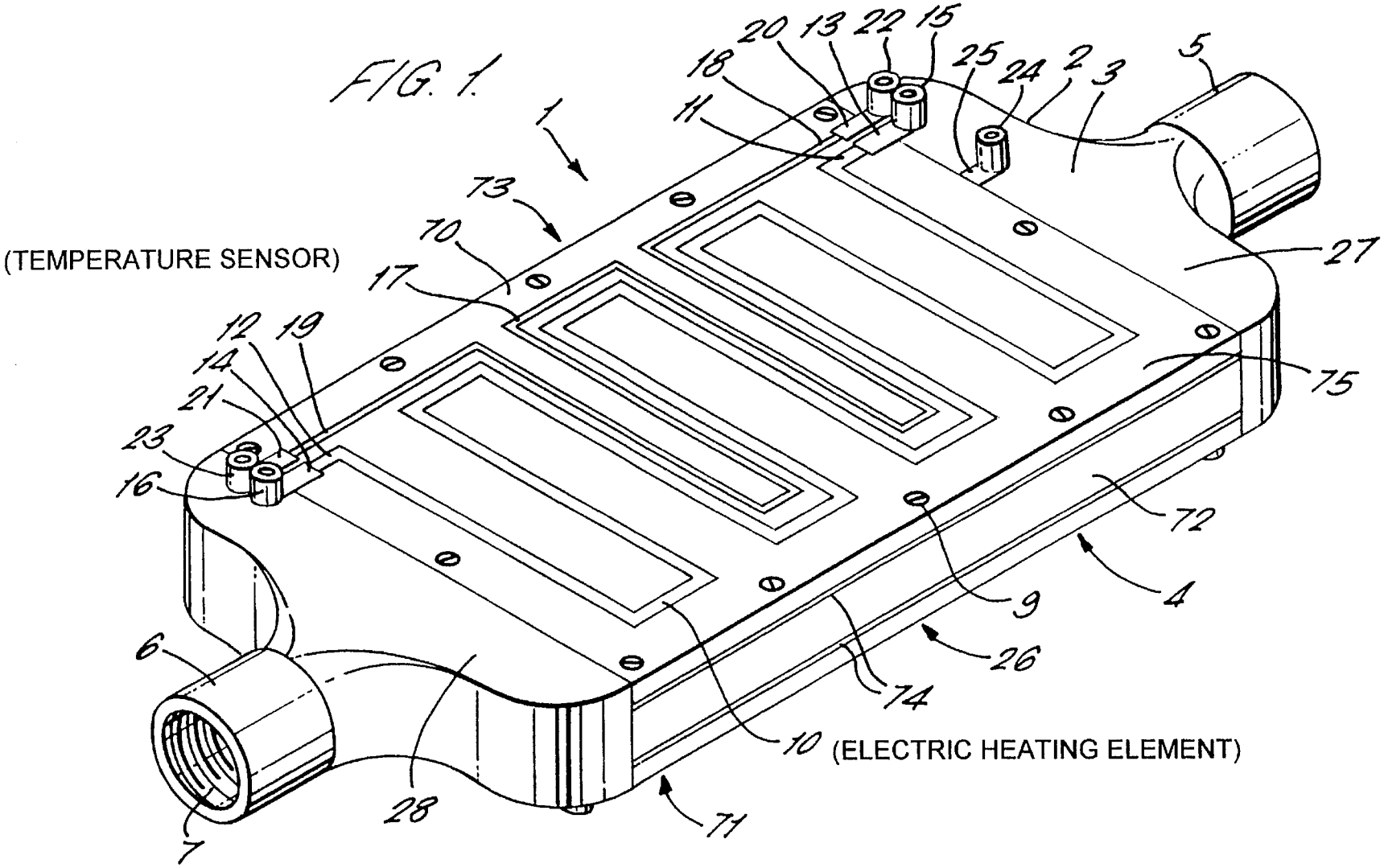
FIG. 1 is a perspective view of, heating apparatus comprising a heater assembly for heating liquid.

The heater assembly 1 of FIG. 1 comprises a vessel 2 which resembles in external appearance a flattened bottle having parallel, generally flat front and rear faces 3 and, 4, respectively.

An inlet pipe 5 and an outlet pipe 6 are integrally formed with first and second end portions 27 and 28 respectively of the vessel 2 for the inlet and outlet of liquid in use. The pipes 5 and 6 include threaded connectors 7 suitable for connection to conventional water pipe couplings. The end portions 27 and 28 are formed of a high melting point plastics material.

Front and rear plates 70 and 71 respectively extend between the end portions 27 and 28 and are connected by side panels 72 and 73 such that the end portions, front and rear plates and side panels together define a chamber communicating with the inlet and outlet pipes 5 and 6.

The plates 70 and 71 are sealed to the side panels 72 and 73 by gaskets 74 and secured by screws 9.

Each of the plates 70 and 71 constitutes a stainless steel substrate of a thick film circuit comprising a dielectric layer 75 upon which is formed a heating element 10.

The heating element 10 comprises a conductive track formed of pure nickel having first and second end portions 11 and 12 respectively with which electrical contact is made by means of spring contacts 13 and 14 respectively of electrical terminals 15 and 16 respectively. The heating element 10 follows a path which is of square wave appearance in plan view such that the length of the track is about three times the separation between the terminals 15 and 16 and the effect of passing electric current through the track is to provide heat in a pattern distributed over substantially the whole of the plate 70.

A resistive track 17 formed of a standard thick film resistor material is also formed on the dielectric layer 75. The resistive track 17 has first and second end portions 18 and 19 with which electrical contact is made by spring contacts 20 and 21 respectively of terminals 22 and 23 respectively. The resistive track 17 is inter-digitated with the heating element 10 and constitutes a thermistor arranged to sense the overall temperature of the plate 70.

The plate 70 is additionally provided with an earth terminal 24 which is connected to the substrate by a tag 25.

A further heating element (not shown) corresponding to heating element 10 is mounted on the rear plate 71 of the vessel 2 and is referred to using corresponding reference numerals for corresponding elements.

In use as a water heater, water is admitted to the inlet pipe 5 and delivered from the outlet pipe 6 whilst each heating element 10 is energised by applying a voltage across terminals 15 and 16. Electric current flowing through the heating elements provides heat which is conducted through the plates 70, 71 to heat the water. The temperature of the heating elements 10 is sensed by a suitable control circuit (not shown) which senses the resistance of resistive track 17 and provides a thermal cut-out if the temperature of the plate exceeds a threshold value.

The plates 70, 71 are earthed by connecting the earth terminals 24 to a suitable earth point.

The end portions 27 and 28 may alternatively be formed of metallic material. If connected to a water supply comprising metal piping then such a metallic vessel would include thermally and electrically isolating pipe connectors to isolate the vessel from water supply apparatus.

The heating apparatus 1 may be used as a domestic water heater and may for example be incorporated in a shower unit.

Figure 2:
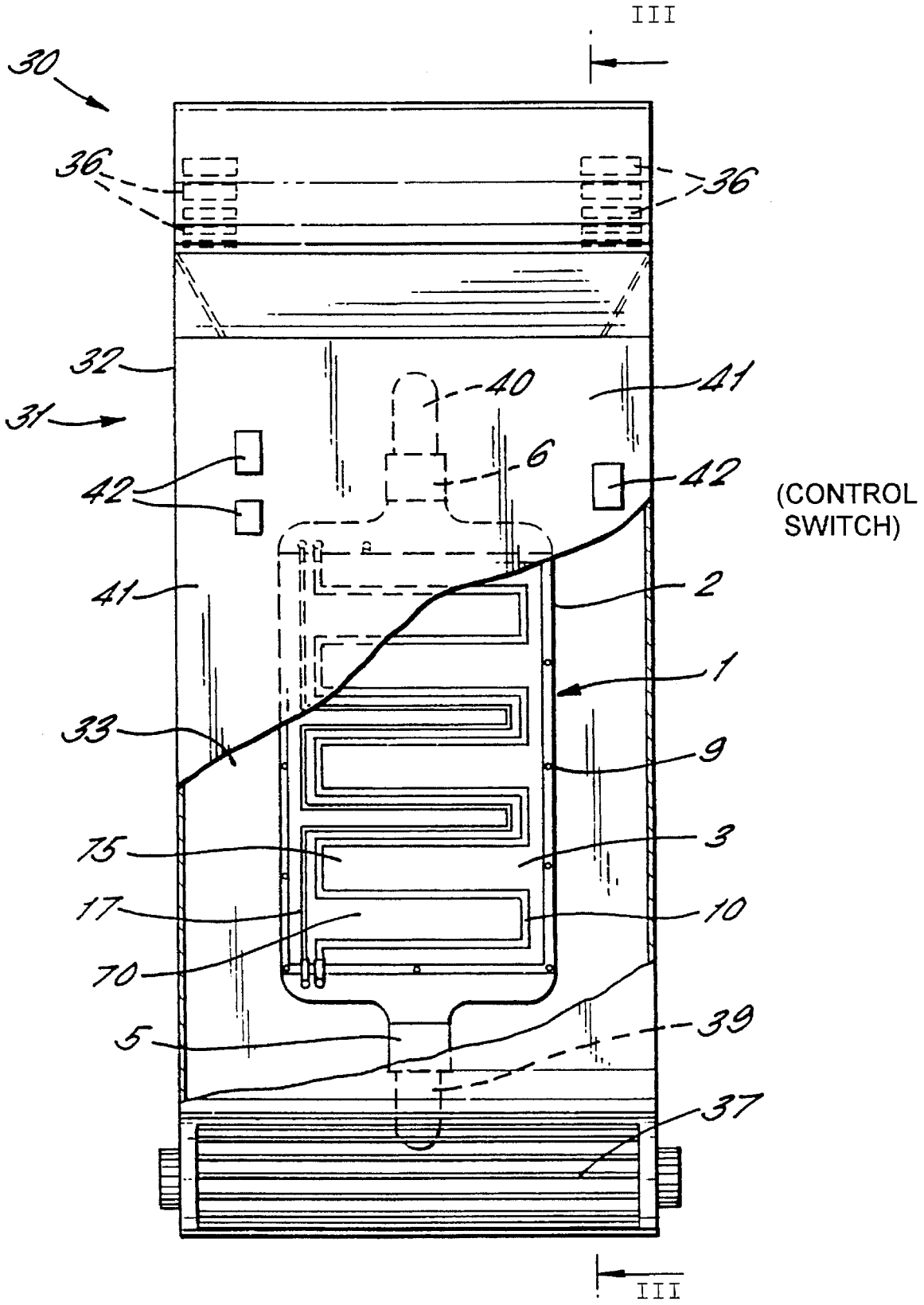
FIG. 2 is a front elevation of an alternative heating apparatus comprising a combined water heater and hot air blower unit.
Figure 3:
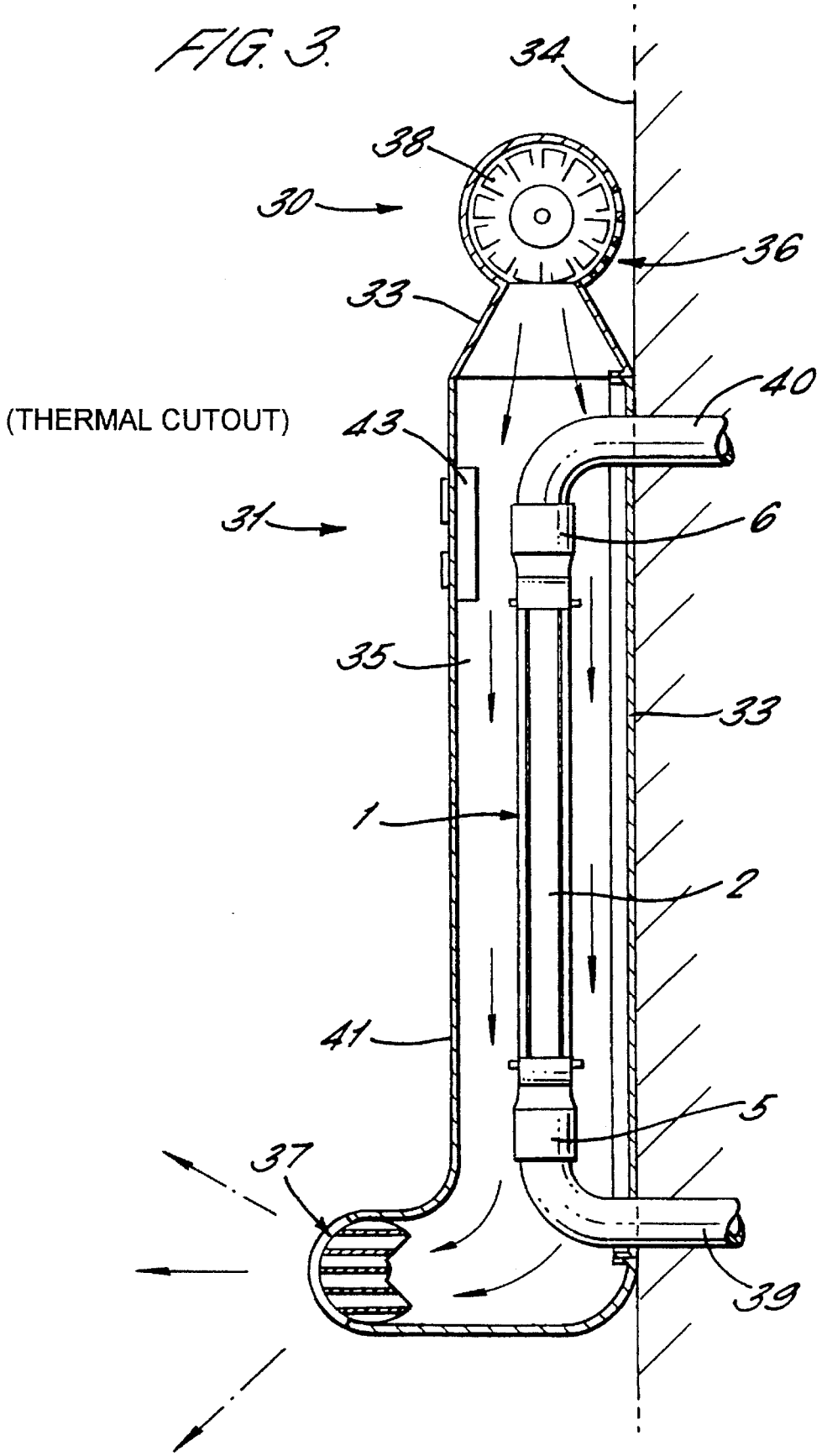
FIG. 3 is a referral view of FIG. 2 as seen along line 3—3.

Apparatus 30 shown in FIGS. 2 and 3 incorporates the heating apparatus 1 shown in FIG. 1 in a combined water heater and hot air blower unit 31.

Corresponding reference numerals to those of FIG. 1 are used where appropriate for corresponding elements.

The unit 31 comprises a housing 32 which is generally rectangular in shape and has a rear wall 33 secured to a supporting structure 34. The housing 32 defines an air duct 35 extending from an inlet 36 to an outlet 37 and an electrically operated air blower 38 and is operable to provide a flow of air through the duct.

The heater assembly 1 is supported in the duct 35 such that the plates 70 and 71 are parallel to the rear wall 33 and the relative positions of the inlet 36 and outlet 37 are such that the air flow in the duct passes over the heating elements 10 in a downward direction.

The inlet pipe 5 of the heater assembly 1 is connected to a water supply pipe 39 which projects from the supporting structure 34 and through the rear wall 33 into the air duct 35. Similarly the outlet pipe 6 is connected to a water outlet pipe 40 extending through the rear wall 33 and into the supporting structure 34.

The housing 32 has a front wall 41 upon which are mounted control switches 42 and a thermal cut-out circuit 43.

In use to supply hot water a user operates a water flow control valve (not shown), but of a type known to those skilled in the art, for example, see EP application 0201967 to permit water to flow through the vessel 2 of the heater assembly 1 and control switches 42 are operated to energise the heating elements 10. Water flowing through the vessel 2 will therefore be heated to a temperature dependent upon the flow rate and the amplitude of heating current. If the flow of water is interrupted, then overheating of the plates 70 and 71 above a threshold limit may occur, in which case the thermal cut-out circuit 43 operates to discontinue the heating current.

The unit 31 may alternatively be operated as a hot air blower by actuating control switches 42 to energise the air blower 38 and the heating elements 10 whilst the water control valve remains closed. Air drawn in through the inlet 36 flows through the duct 35 and is heated by the heating elements 10 to emerge from the outlet 37 as hot air. The unit 31 may if required be used to deliver simultaneously both hot water and hot air by opening the water control valve.

The unit 31 may be incorporated in a shower unit in which the water outlet pipe 40 is connected to a shower nozzle and the hot air outlet 37 is positioned to assist drying after use of the shower. The unit 31 may alternatively be used to supply hot water to a tap or faucet of a wash basin or bath.

Figure 4:
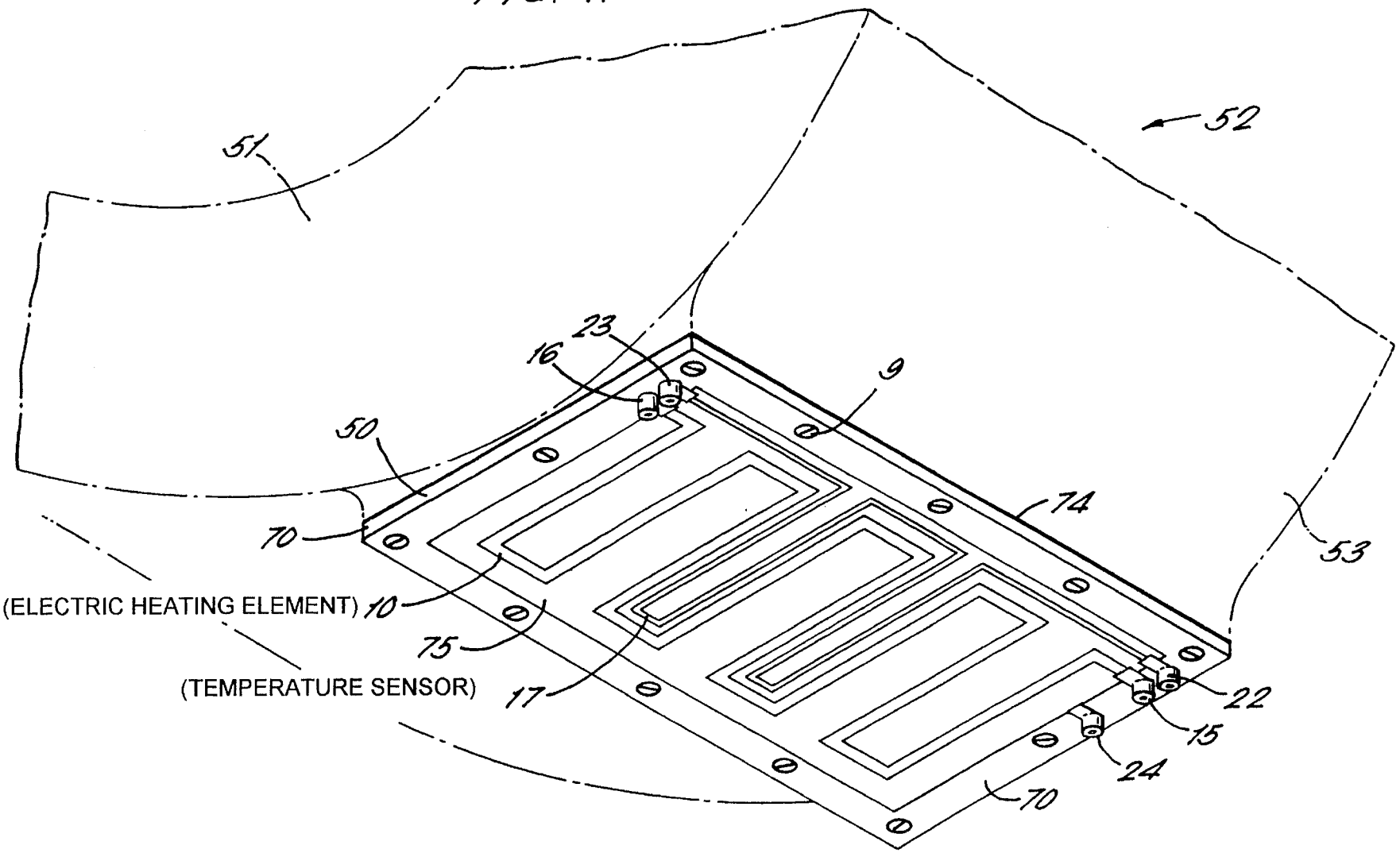
FIG. 4 is a perspective view of an alternative heating apparatus comprising a heated panel for use in a washing machine.

FIG. 4 shows a perspective external view of a drum 51 of a washing machine 52 which includes a heated panel 50. The drum 51 constitutes a vessel defining a chamber receiving water in use. The heated panel 50 is constructed in similar manner to the panel 70 of the apparatus of FIG. 1 and corresponding reference numerals are used where appropriate in describing corresponding elements.

The heated panel 50 comprises a stainless steel plate 70 which forms the substrate of a thick film printed circuit in which a heating element 10 is printed onto a dielectric layer 75 on one side of the plate. The plate 70 is oriented such that the circuit is formed on a face which is external to the drum 51 and the other face of the plate which is of stainless steel forms part of the inner surface of the drum. A temperature sensing resistive track 17 is similarly provided and connected via terminals 22 and 23 to a thermal cut-out circuit.

The drum 51 has a cylindrical wall 53 in which a rectangular aperture is formed and the plate 70 is connected to the wall 53 by screws 9 so as to close the aperture. A sealing gasket 74 provides a peripheral seal to the plate 70.

Figures 5, 6:
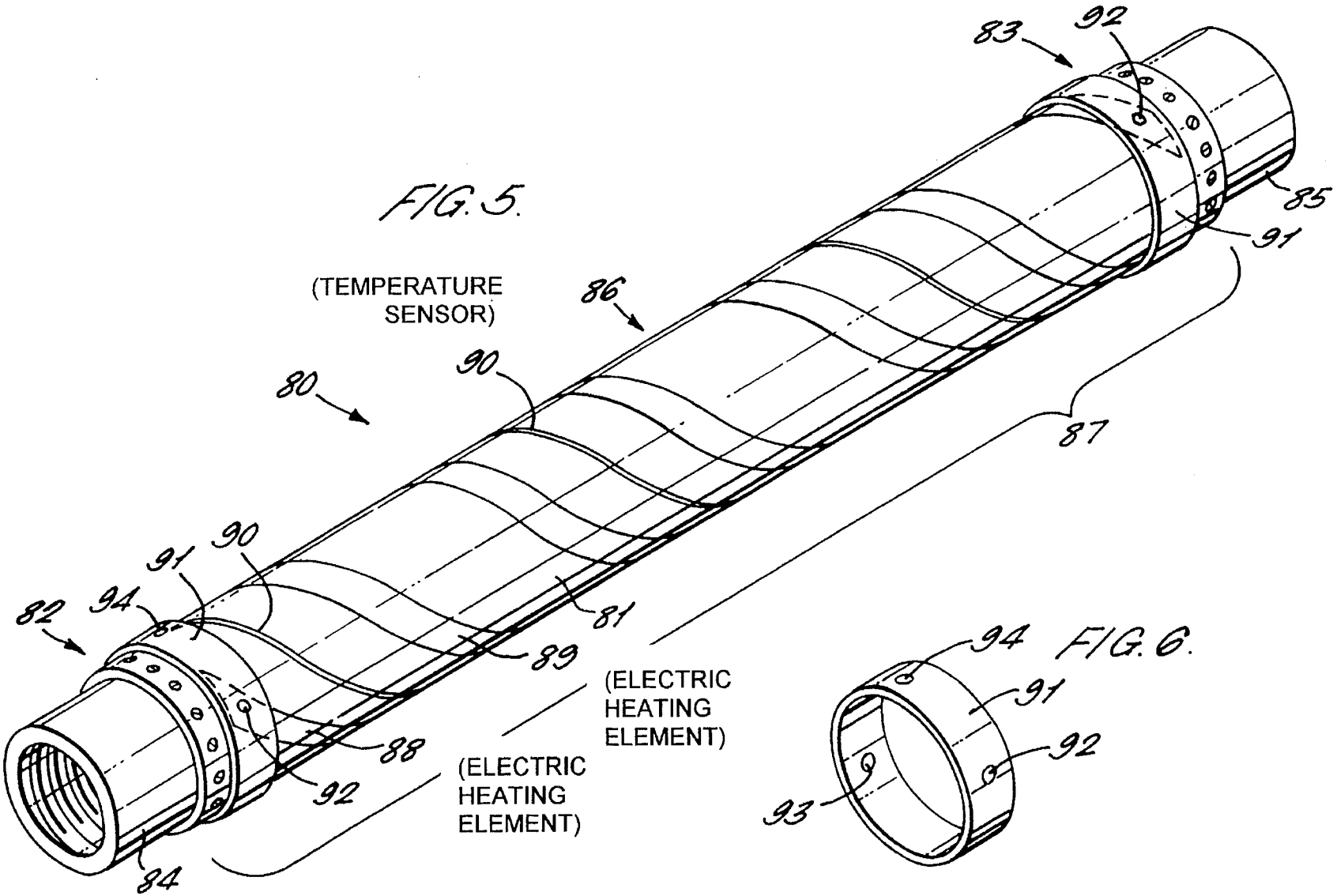
FIG. 5 is a perspective view of a tubular heating apparatus for heating liquid.
FIG. 6 is a perspective view of a collar of the apparatus of FIG. 5.

A tubular heating apparatus 80 is shown in FIG. 5 and comprises a stainless steel pipe 81 having first and second end portions 82 and 83 connected to conventional fluid pipe couplings 84 and 85 respectively formed of a high melting point plastics material.

A thick film printed circuit 86 is formed on a middle portion 87 of the pipe 81 such that the middle portion of the steel pipe serves as a substrate for the thick film circuit.

First and second heating elements 88 and 89 respectively are printed on the printed circuit 86 in the form of conductive tracks of pure nickel. The heating elements 88 and 89 are each of helical shape and of equal pitch and initiate from diametrically opposed locations so as to remain spaced apart throughout the length of the pipe 81. A resistive track 90 is also printed on the printed circuit 86 and follows a helical path of equal pitch to that of the heating elements 88 and 89 so as to remain electrically isolated from each of the heating elements.

At each end portion 82 and 83 electrical connection is made with the heating elements 88 and 89 and the resistive track 90 respectively by means of a respective collar 91 as shown in FIG. 6. Each collar 91 is formed of an insulating material and carries electrical terminals 92, 93 and 94 which make contact with the heating elements and the resistive track respectively.

The tubular heating apparatus 80 may be used to heat liquid by passing liquid through the pipe 81 and energising one or both of the heating elements 88 and 9 by connection to a source of electrical current. The resistive track 90 may be connected to a thermal cut-out circuit arranged to cut off the electric current if the temperature of the pipe 81 exceeds a threshold value.

A further alternative apparatus 100 is shown in FIG. 7 constituting a hot water supply system 101 for a domestic shower unit.

The apparatus 100 comprises a heater assembly 102 shown in FIG. 8 and which is similar to the heater assembly 1 of FIG. 1. Corresponding reference numerals to those of FIG. 1 are used where appropriate for corresponding elements. The heater assembly 102 however includes a modified front plate 103 in which heating element 10 is connected to a current regulating circuit 104 in the form of a thick film circuit mounted on the dielectric layer 75. The current regulating circuit 104 is of the TRIAC type and receives current from a mains supply via conductors 105. The circuit 104 is also connected to a control unit 106 to receive a control signal 113 as illustrated in FIG. 7.

The current regulating circuit 104 also includes a thermal cut-out arranged to shut off power to the heating element 10 in the event of overheating being sensed. The heater assembly 102 has an outlet pipe 6 to which is mounted a temperature sensor 107 having an output 112 which is connected to the control unit 106 as illustrated in FIG. 7. See, for example, the aforementioned EP Application and U.S. Pat. No. 5,354,967.

The heater assembly 102 has an inlet pipe 5 to which is mounted a manually operated flow control valve 108 with a flow rate setting control 109. The flow control valve 108 is capable of continuous adjustment of flow rate between a minimum flow rate and a maximum flow rate in which the valve is fully opened. Actuation of the flow rate setting control 109 to produce a flow less than a predetermined minimum flow rate results in the flow being completely shut-off. The minimum flow rate is in this example 10% of the maximum flow rate.

The flow control valve 108 is also provided with electric contacts (not shown) responsive to the valve setting being such as to provide less than the predetermined minimum flow rate, the contacts being arranged so as to produce a control signal 110 which is input to the control unit 106.

A temperature setting control 111 is provided on the control unit 106.

In use, where the outlet pipe 6 is connected to a shower nozzle, a user first selectes a required temperature using the temperature setting control 111 and turns on the flow of water using the flow rate setting control 109 until a required flow rate is received. A supply of heating current is delivered to the heating element 10 by the current regulating circuit 104 in response to a command signal 113 from the control unit 106 and water passing through the heater assembly 102 is heated. The temperature of water passing through the outlet pipe 6 is sensed by the temperature sensor 107 and the control unit 106 responds to the output signal 112 of the temperature sensor by varying the control signal 113 to the current regulating circuit 104 such that the temperature is stabilised at the selected temperature.

The hot water supply system 101 is thereby provided with a closed feedback control of temperature. When the user wishes to turn off the flow, the flow rate setting control 109 is set to zero flow thereby generating a control signal 110 which is received by the control unit 106 and results in the current regulating circuit 104 being turned off.

The control unit 106 includes a safety feature to detect any failure of the mains water supply which would reduce to zero or near zero the flow of water. The control unit 106 is for this purpose provided with a trip circuit to shut off power to the heater assembly 102 when the control signal 113 to the current regulating circuit 104 drops below a threshold level (say 10% of the maximum signal level). In the event of failure of the mains water supply the flow control valve 108 remains open but the rate of flow decreases so that progressively less current is required to maintain the temperature at its controlled level. The value of control signal 113 therefore progressively decreases until the threshold level is reached.

The current regulating circuit 104 is mounted on the front plate 103 at a location upstream of the heating element 10 so that the front plate acts as a heat sink which is cooled by the flow of water. It is therefore not necessary for a separate heat sink to be provided for the current regulating circuit 104.

The heater assembly 102 allows the use of feedback control of water temperature in a shower by virtue of the low thermal capacity of the plate 103 and heating element 10 when compared with prior art water heaters for this use.

The heater assembly 102 thereby enables the temperature to be controlled in a manner which is substantially independent of fluctuations in the pressure of mains water supply and fluctuations in the supply temperature.

The heater assembly 102 also, by virtue of its improved thermal conduction and response time, is able to operate at a lower operating temperature than required in heating elements of prior art devices for this purpose. Where for example in a prior art device a heating element is immersed in the water within the chamber there has been a tendency for the heating element to become furred in use so that it rapidly becomes inefficient. The heater assembly of the present invention is less susceptible to furring since it operates at a lower temperature.

The heating apparatus 100 of FIG. 7 may alternatively include a flow valve of a type which includes a time delay facility such that the flow is shut off a few seconds after the minimum flow rate is selected. Additional cooling of the heating apparatus is thereby provided to reduce the initial temperature of water when the valve is turned on after only a short delay. Such a time delay facility will not however generally be necessary because of the inherent low thermal capacity of the heater assembly 102. The temperature sensor 107 may comprise a thermistor or like device formed on the thick film circuit of the heating element at a location adjacent to the outlet 6.

Figure 9:
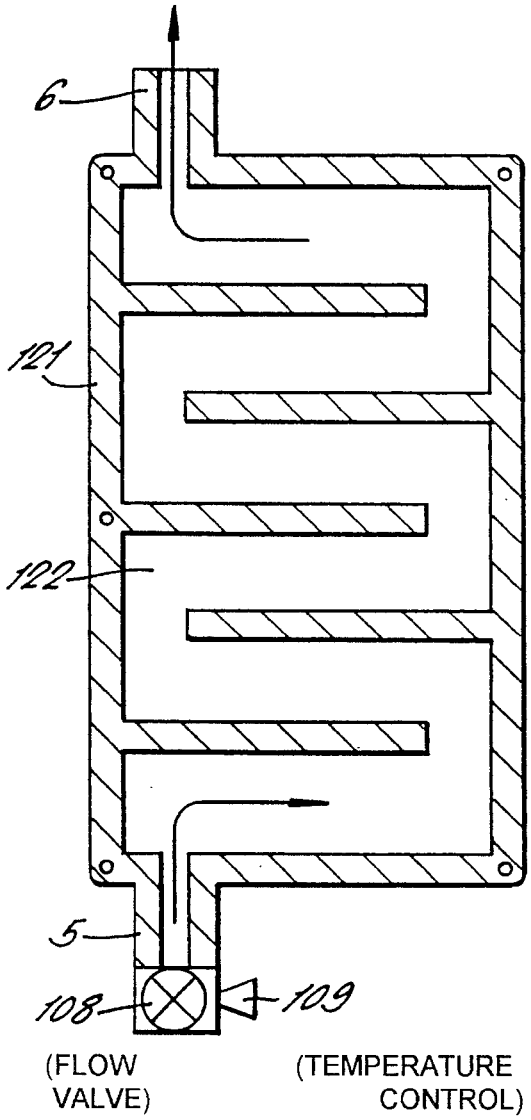
FIG. 9 is a sectioned elevation of a further alternative apparatus comprising a water heater for a shower.
Figure 10:
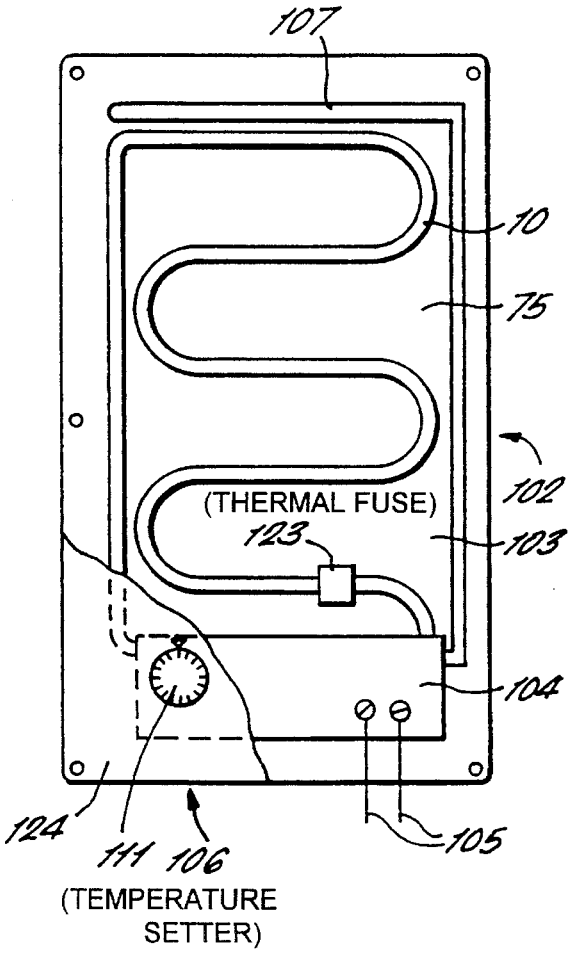
FIG. 10 is an elevation of the heater assembly of FIG. 9 showing a heating element and control unit.

A further alternative heating apparatus 120 is shown in FIGS. 9 and 10 and will be described using corresponding reference numerals to those of FIGS. 7 and 8 where appropriate for corresponding elements.

The apparatus 120 is similar to the apparatus 100 shown in FIGS. 7 and 8 and is intended for the supply of hot water for a domestic shower unit. The apparatus 120 has an inlet pipe 5 which is lowermost so that water rises through a vessel 121 to emerge from outlet pipe 6 which is uppermost. The vessel 121 defines a zig-zag pathway 122 through which the water travels and is overlaid by a heater assembly 102 having a heating element 10 which follows generally the pathway 122.

The heating element 10 is formed in the same way as that of apparatus 100 and comprises a conductive track formed as a thick film circuit on dielectric layer 75 which in turn is formed on a metal substrate forming part of the vessel 121.

Apparatus 120 includes a temperature sensor 107 comprising a thermistor formed as a resistive track on the dielectric layer 75. The temperature sensor 107 extends into proximity with the outlet pipe 6 so as to enable the outlet water temperature to be sensed.

A thermal fuse 123 is connected in line with the heating element 10 and is mounted on the dielectric layer 75 as part of the thick film circuit. The thermal fuse 123 is operable to shut off current through the heating elements 10 when the temperature of the heater assembly 102 exceeds a safety limit.

Apparatus 120 includes a control unit 106 performing the same function as that described with reference to apparatus 100 but the control unit of apparatus 120 is formed as part of the same thick film circuit constituted by the heating elements 10, temperature sensor 107 and current regulating circuit 104. Components of the control unit 106 are surface mounted on the dielectric layer 75 at a location close to the inlet pipe 5 at which location the metal substrate of the heater assembly 102 is kept cool by the flow of cold water entering the vessel 121.

The heater assembly 102 is overlaid by a front cover 124 shown partially in FIG. 10 and a temperature setting control 111 extends through the front cover so as to be accessible for the setting of the required temperature.

Figure 11:
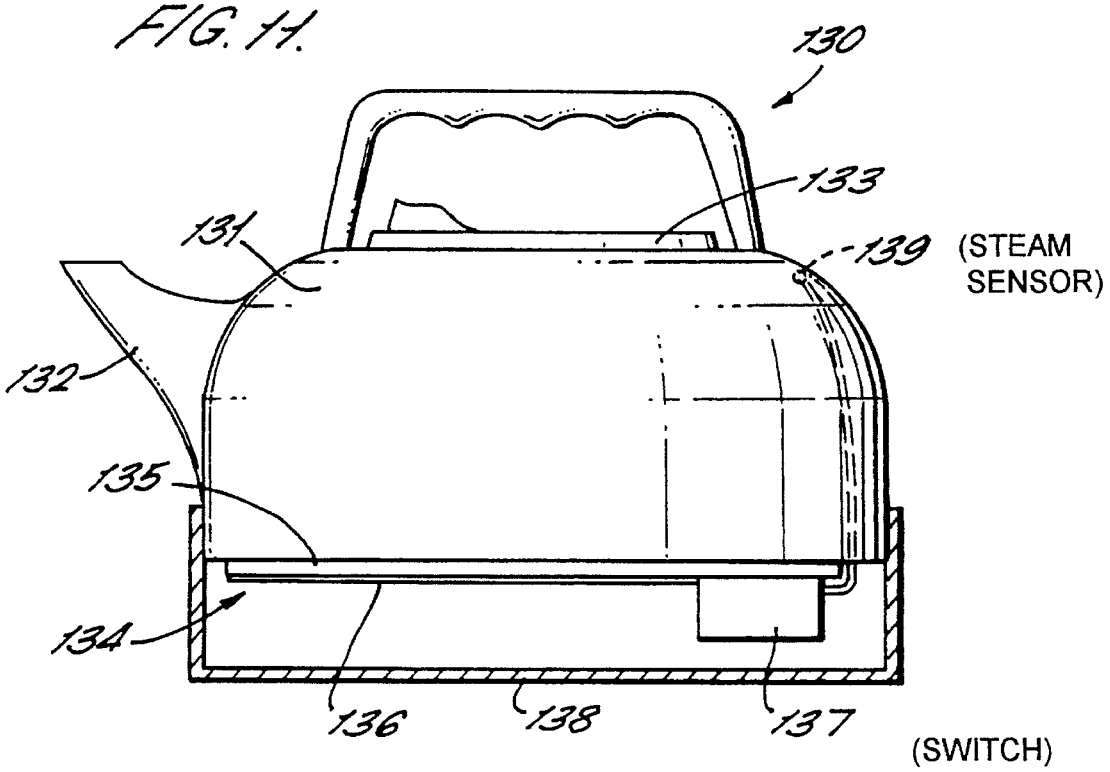
FIG. 11 is a sectioned elevation of an alternative apparatus comprising a kettle.
Figure 12:
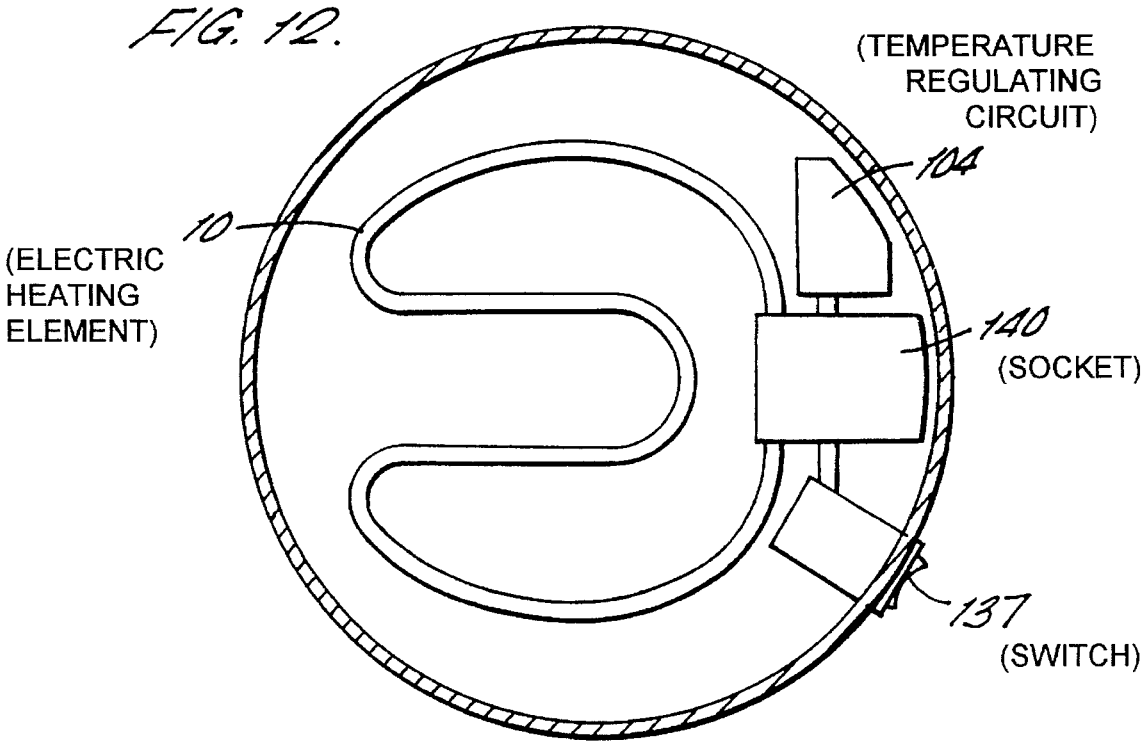
FIG. 12 is a sectional view of FIG. 11 as seen along line 12—12.

A further alternative heating apparatus comprising a kettle 130 is shown in FIGS. 11 and 12 and will be described using corresponding reference numerals to those of preceding figures where appropriate for corresponding elements.

The kettle 130 comprises a vessel 131 defining an outlet spout 132 and having a removable lid 133 and in this respect resembles a conventional electric kettle. The kettle 130 however is heated by means of a heater assembly 134 comprising a stainless steel plate 135 which forms an integral part of the vessel 131. The plate 135 also constitutes the substrate of a thick film circuit 136 in which a dielectric layer (not shown) is formed on the plate and carries a heating element 10 in the form of a conductive track as shown in FIG. 12.

A current regulating circuit 104 forms part of the thick film circuit 136 and operates to both control and regulate current passing through the heating element 10 and is connected to a side operated switch 137 which is mounted so as to be manually accessible.

The vessel 131 is supported on a base 138 which encloses the thick film circuit 136 so as to exclude water and to thermally and electrically isolate the heater assembly from contact with a supporting surface.

A steam sensor 139 is connected to the current regulating circuit 104 and is located on the vessel 131 so as to provide a signal indicating that water within the vessel is boiling.

The heating element 10 is also used to sense the temperature of the plate by means of suitable circuitry within the circuit 104 arranged to measure the resistance of the heating element. The switch 137 is provided with an "off" position, an "on" position corresponding to a water boiling mode and also an intermediate position corresponding to a water simmering mode in which temperature is controlled at 90° C. by regulating the current through the heating element 10 in response to the sensed temperature. In this intermediate position of the switch 137, water can be kept simmering in readiness for being rapidly re-heated to boiling point when required.

The steam sensor 139 is arranged to sense boiling of the water in the kettle in response to which current through the heating element 10 is reduced by the means of the current regulating circuit 104.

Assembly of the kettle 130 is therefore simpler than in prior art kettles because the circuitry and heating element are integrated onto a single substrate assembly. The current regulating circuit 104 includes a triac circuit enabling the current through the heating element 10 to be continuously varied in order to maintain the water temperature at a required level in the intermediate setting of the control switch 137. A thermal fuse (not shown) is also included in the heating element 10 and is arranged to cut off current in the event of temperature exceeding 150° C.

The current regulating circuit 104 may be arranged to automatically switch the status of the switch 137 from the boiling setting to the intermediate setting in response to boiling point being sensed by the steam sensor 139. Such an arrangement avoids the problem of an unattended kettle automatically switching off in response to boiling point having been reached and the water having cooled excessively when it is required for use. By maintaining the temperature close to boiling point in the intermediate setting of the switch the water can be rapidly returned to boiling point when required.

The switch 137 may alternatively be a key pad having light emitting diode indicators as to the mode in which the circuit 104 is operating.

Kettle 130 is provided with a conventional mains socket 140 for connection to a domestic electric mains supply.

In each of the above examples the thick film circuit is formed by initially firing a stainless steel substrate in an oven to form a chromium oxide surface layer, the firing process being carried out at a temperature of 850° C. to 900° C. A first dielectric adhesion layer is then adhered to the oxidised steel substrate, the adhesion layer being selected to have a coefficient of thermal expansion approximately equal to that of the steel. One or more further separate coatings are then separately applied such that the final coating has a coefficient of thermal expansion approximately equal to a thick film ink. Any intermediate buffer coatings are arranged to provide a gradient of intermediate coefficients of thermal expansion.

A thick film circuit layout is then applied by silk-screen printing in which a conductive track constituting the heating element and a resistive track constituting a temperature sensor are printed. An encapsulating layer may then finally be applied over the completed circuit. In the case of the tubular heating apparatus 80 the printing process requires printing onto a cylindrical surface and known techniques exist for such printing in which the substrate is rotated about its cylindrical axis during application of printed layers.

The thick film circuit may be applied only to one face of the steel sheet or pipe as described above with reference to the examples in FIGS. 1 to 6. Alternatively the steel sheet or pipe may receive a dielectric coating on both faces. This provides the additional advantage of a protected surface being exposed to the fluid to be heated.

The heating element may alternatively be formed of other conducting materials such as silver, silver palladium or carbon for example.

We claim:

1. A heating apparatus comprising a vessel defining a chamber for heating a fluid and having a heater portion, said heater portion comprising:

a chromium containing stainless steel substrate having a coefficient of thermal expansion and an oxidized surface layer comprising chromium oxide, said surface layer having been formed by heating said stainless steel substrate to oxidize chromium present in said substrate;

a dielectric layer applied to and adhered to said surface layer and having a coefficient of thermal expansion which approximately equals that of the stainless steel substrate; and a thick film conductive printed circuit electric heating element formed on said dielectric layer.

2. A heating apparatus as claimed in claim 1, comprising a temperature sensing means, a control means connected to the temperature sensing means and operable to generate a control signal, and a current regulating means operable to regulate current in the heating element in response to the control signal.

3. Heating apparatus as claimed in claim 2 wherein the temperature sensing means comprises a thermistor formed as a second conductive track of measurable resistance on the thick film circuit.

4. A heating apparatus as claimed in claim 3 wherein the second conductive track is inter-digitated with the conductive track comprising the heating element.

5. A heating apparatus as claimed in claim 2 wherein the control means comprises a control circuit formed as a thick film circuit on the steel substrate of the heating element.

6. A heating apparatus as claimed in claim 2 including a thermal cut-out connected to the temperature sensing means and arranged to cut off the flow of electric current through the heating element when the temperature sensed by the temperature sensing means exceeds a limiting value.

7. A heating apparatus as claimed in claim 2, wherein the vessel defines an inlet connectable in use to a source of liquid and an outlet for the delivery of heated liquid from the chamber, and wherein the temperature sensing means extends into proximity with the outlet so as to be operable to sense the temperature of liquid flowing from the outlet.

8. A heating apparatus as claimed in claim 7 wherein the current regulating means is located adjacent to the inlet.

9. A heating apparatus as claimed in claim 7 comprising a valve connected in series with the inlet and operable to continuously vary the flow of liquid through the chamber, a valve sensor connected to the valve and operable to provide a disabling signal to the control means if the valve is so set as to provide a flow rate of liquid below a threshold level, and the control means being operable to turn off the current to the heating element in response to the disabling signal.

10. Heating apparatus as claimed in claim 2 comprising an apparatus for boiling water, and wherein a steam sensor is provided connected to the current regulating means which in a water boiling mode operate to deliver a maximum level of current to the heating element until boiling point is sensed by the steam sensor and thereafter operate in a water simmering mode in which a reduced level of current is delivered to the heating element.

11. A heating apparatus as claimed in claim 10 wherein the current regulating means is connected to the temperature sensing means and is operable in the water simmering mode to regulate the current so as to maintain a required temperature.

12. A heating apparatus as claimed in claim 11 wherein the required temperature is 90° C.

13. A heating apparatus as claimed in claim 10 wherein the current regulating means is operable automatically to switch from the water boiling mode to the water simmering mode in response to boiling of the water being sensed by the steam sensor.

14. A heating apparatus as claimed in claim 1 comprising a thermal fuse in line with the heating element and constituted by an element which is integrally formed on the thick film circuit of the heating element.

15. A heating apparatus as claimed in claim 1 comprising an air duct and blower means operable to provide air through the duct and wherein at least the heated portion of the vessel is located within the duct whereby the apparatus is operable to supply heated liquid and heated air.

16. A heating apparatus as claimed in claim 1, wherein the surface layer of said substrate is formed by firing the stainless steel substrate at a temperature in the range of 850° C. to 900° C.

17. A heating apparatus as claimed in claim 1, wherein said electric heating element is screen printed on said dielectric layer.

18. A heating apparatus as claimed in claim 1, wherein said oxidized surface layer has been formed by heating said stainless steel substrate to a temperature of at least 850° C.

* * * * *